United States Patent [19]

Hardgrave

[11] 4,214,605

[45] Jul. 29, 1980

[54] ACTUATOR FOR WIRELINE BLOWOUT PREVENTER

[75] Inventor: William D. Hardgrave, Carrolton, Tex.

[73] Assignee: Otis Engineering Corporation, Dallas, Tex.

[21] Appl. No.: 868,482

[22] Filed: Jan. 11, 1978

[51] Int. Cl.[2] ..... E21B 33/06; F16K 31/363

[52] U.S. Cl. ..... 137/495; 137/556; 251/1 A; 251/25; 277/73

[58] Field of Search ..... 251/1 R, 1 A, 1 B, 25, 251/63; 277/73, 126, 127, 129; 166/82, 84, 86, 88; 137/455

[56] References Cited

U.S. PATENT DOCUMENTS

| | | | |
|---|---|---|---|
| 1,854,058 | 4/1932 | Otis | 277/73 X |
| 2,163,178 | 6/1939 | Otis | 277/73 |
| 2,278,050 | 3/1942 | Allen et al. | 277/73 |
| 2,282,363 | 5/1942 | King | 277/127 |
| 3,028,878 | 4/1962 | Natho | 137/556 |
| 3,272,222 | 9/1966 | Allen | 277/127 X |
| 3,692,316 | 9/1972 | Bishop et al. | 277/73 |
| 3,800,822 | 4/1974 | Baker | 137/489.5 |
| 4,076,208 | 2/1978 | Olson | 251/1 A |

OTHER PUBLICATIONS

"1974–1975 Composite Catalogue of Oil Field Eqt. and Services", published by World Oil, p. 4027.

*Primary Examiner*—Martin P. Schwadron
*Assistant Examiner*—Richard Gerard
*Attorney, Agent, or Firm*—Vinson & Elkins

[57] ABSTRACT

Disclosed is an hydraulic actuator for a wireline blowout preventer. The actuator uses well pressure to effect closure of the blowout preventer and hydraulic control fluid to open the blowout preventer.

8 Claims, 3 Drawing Figures

ACTUATOR FOR WIRELINE BLOWOUT PREVENTER

BACKGROUND OF THE INVENTION

1. Field of the Invention

This invention relates to an actuator for a wireline blowout preventer.

2. The Prior Art

U.S. Pat. No. 3,692,316 discloses an hydraulic actuator for a wireline blowout preventer which relies upon pressurized hydraulic control fluid to both open the blowout preventer and effect closure of the blowout preventer. U.S. Pat. No. 2,163,178 discloses a blowout preventer wherein hydraulic fluid is utilized to urge the preventer ram towards its closed position. However, the blowout preventer disclosed in U.S. Pat. No. 2,163,178 cannot be opened hydraulically. The rams of the preventors disclosed in U.S. Pat. Nos. 3,692,316 and 2,163,178 may be mechanically advanced towards their closed position and mechanically locked against movement towards their open position. However, if the preventers are to be closed hydraulically hydraulic control fluid pressure must exceed well pressure. A failure in the hydraulic control system and loss of hydraulic control fluid pressure would render these preventers exceedingly difficult to close against high well pressure.

Certain actuators do utilize the controlled fluid as a source of fluid for affecting operation of a valve. U.S. Pat. No. 1,854,058 discloses communicating well fluids upstream from the ram of the preventer to one side of the actuator piston. The well fluids urge the piston towards a position wherein the ram closes the preventer. The patent additionally discloses that a mechanical sprocket lever may advance the ram of the preventer towards its closed position and that ram closure may be assisted by a screw jack. Once the ram is closed, ram drift may be prevented by the screw jack. However, with the disclosed actuator, no automatic closure of the blowout preventer can be effected whenever well pressure exceeds hydraulic control pressure. Additionally, the disclosure only suggests that upstream well fluids assist the mechanical sprocket lever in urging the preventer rams towards their closed position. The rams and the actuator piston do not and cannot move independently of the sprocket lever. Finally, there is no hydraulic way to open the preventer disclosed in this patent.

U.S. Pat. No. 3,800,822 discloses a pilot valve controlled main valve. The pilot valve, when activated, opens communication between upstream well fluids and the actuator piston chamber. The pressure of the upstream well fluids thereafter moves the main valve to its closed position. There is no disclosed hydraulic means for opening the main valve. Neither are there any disclosed mechanical means for advancing the main valve towards its closed position and maintaining the main valve in its closed position. Finally, well fluids are not confined by the disclosed main valve, actuator and pilot valve combination. Opening of the main valve requires that well fluids be bled from the actuator piston chamber. Bleeding well fluids out of the system is not always possible and may be unsafe.

A "TYPE X OTIS ACTUATOR" as disclosed on page 4027 of the 1974–75 edition of the "COMPOSITE CATALOG OF OILFIELD EQUIPMENT AND SERVICES" is a pilot valve controlled actuator. One side of the actuator piston is always affected by upstream fluids. The pilot valve controls communication between the other side of the actuator piston and the upstream fluids. When the pilot valve is closed, the communicating passage is opened and the piston is pressure balanced. The main valve may be moved to its open position. However, since the piston is pressure balanced, mechanical means are required to move the main valve to its open position. When the pilot valve opens, the communicating passage closes. Opening of the pilot valve bleeds upstream fluids from the piston chamber. The required bleeding of fluids renders the actuator impractical for certain installations. Additionally, there are no disclosed mechanical means for assisting movement of the main valve member towards its closed position and for locking the main valve member in its closed position.

U.S. Pat. No. 4,087,073 discloses another pilot valve controlled actuator for a main valve. Normally, the pilot valve is closed and fluids upstream of the main valve affect only one side of the actuator piston. The piston in turn maintains the main valve opened. When the pilot valve opens, the piston becomes pressure balanced. A spring moves the piston to a second position wherein the main valve member closes the main valve. To reopen the main valve requires that the other side of the piston be bled of the upstream well fluids which have entered therein. Under certain circumstances the required bleeding of upstream fluids from the piston chamber is unsafe and cannot be performed. Since the actuator is pilot valve controlled, there is no automatic closure whenever well pressure exceeds control fluid pressure. Additionally, there are no net fluid forces on the piston during closure. Finally, there are no mechanical means for positively advancing the main valve member towards its closed position.

OBJECTS OF THE INVENTION

An object of this invention is to provide an actuator for a wireline blowout preventer which utilizes upstream well fluids to urge the preventer ram to its closed position and which may be hydraulically opened.

Another object of this invention is to provide an actuator for a wireline blowout preventer which uses upstream well fluids to urge the rams to their closed position and which is operable without any bleeding of well fluids from the actuator and the preventer.

Another object of this invention is to provide an actuator for a wireline blowout preventer wherein upstream well fluids provide a force tending to urge the rams towards their closed position and also including mechanical means for advancing the rams towards their closed position and wherein the rams may be moved by well fluids to their closed position independently of the mechanical advancing means.

Another object of this invention is to provide a hydraulic actuator for a wireline blowout preventer which includes a piston affected by upstream well fluids and also affected by control pressure and which actuates closure of the preventer whenever well pressure exceeds control pressure.

These and other objects and features of advantage of this invention will be apparent from the drawings, detailed description, and the appended claims.

BRIEF DESCRIPTION OF THE DRAWINGS

In the drawings, wherein like numerals indicate like parts, and wherein an illustrative embodiment of this invention is shown.

DETAILED DESCRIPTION OF THE PREFERRED EMBODIMENT

Various well operations are performed once the tubing has been hung and the wellhead interconnected therewith. Generally, well equipment is run through the wellhead and into the well. One manner of running well equipment through the wellhead and into the well is with a wireline.

Figure 1:
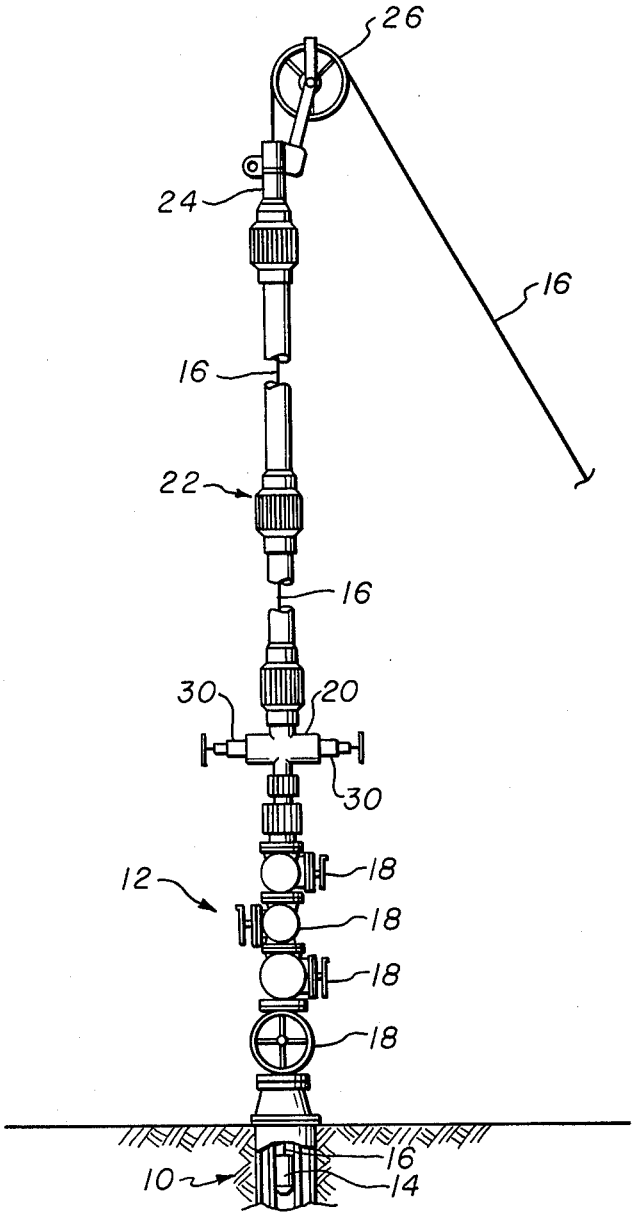
FIG. 1 is a schematic illustration of a wellhead equipped for wireline operations and including a blowout preventer having an actuator in accordance with this invention.

In FIG. 1, a well 10 and wellhead 12 are illustrated together with various wireline equipment. A tool 14 is being run into the well 10 by a wireline 16. To run the tool 14 into the well 10, the wireline 16 must extend through the wellhead 12. The valves 18 of the wellhead 12 are opened to permit the wireline 16 to extend therethrough. Thus, while wireline operations are being performed, the wellhead valves 18 cannot be closed and cannot control the well. To shut in the well and confine well fluids therein, a wireline blowout preventer 20 is positioned on top of the wellhead 12. In an emergency, or when desired, the wireline blowout preventer 20 can be closed quickly. Well fluids are thereby confined. Thereafter, the more slowly closable valves 18 of the wellhead 12 can be closed.

Above the wireline blowout preventer 20 extends a lubricator 22. The lubricator 22 includes a central receptacle in communication with the flow path through the wireline blowout preventer 20. The lubricator 22 permits a wireline tool train to be made up, connected to the wireline 16, and positioned in alignment with flow path through the wireline blowout preventer 20 prior to the opening of the valves 18 of the wellhead 12. Above the lubricator 22 is a wireline stuffing box 24 through which wireline 16 is admitted and retrieved from the well 10. A sheave 26 directs the wireline 16 to the stuffing box 24 from a conventional reel storage means (not shown).

During wireline operations, the wireline operator must be able to close the wireline blowout preventer 20 at any time. Closure should be swift and easily obtainable. In accordance with this invention, hydraulic actuator means 30 actuate operation of the wireline blowout preventer 20. The hydraulic actuator means 30 hydraulically opens the wireline blowout preventer whenever the pressure of hydraulic control fluid exceeds well pressure. On the other hand, the actuator 30 closes the blowout preventer 20 whenever well pressure exceeds hydraulic control pressure. The actuator includes mechanical means for assisting closure of the blowout preventer 20. The mechanical means may be used to lock the blowout preventer 20 in its closed position. Even though the actuator 30 utilizes well fluids to effect its operation, no well fluids are bled from the actuator 30. Rather, well fluids are entirely confined by the actuator 30 and the blowout preventer 20.

Figure 2:
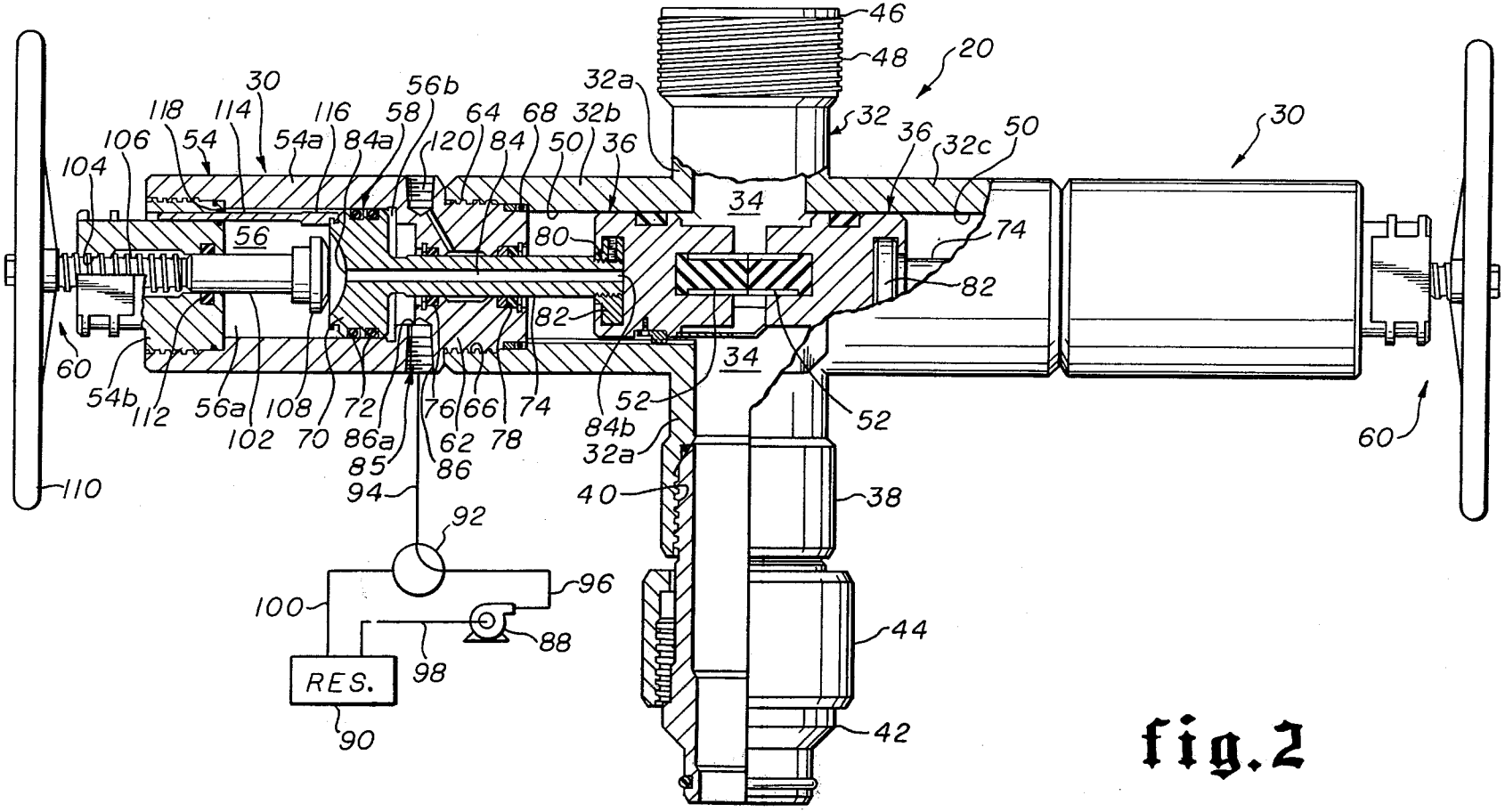
FIG. 2 is an illustration, partly in section and partly in elevation, of the blowout preventer and actuator of FIG. 1 with the preventer in the closed position.
Figure 3:
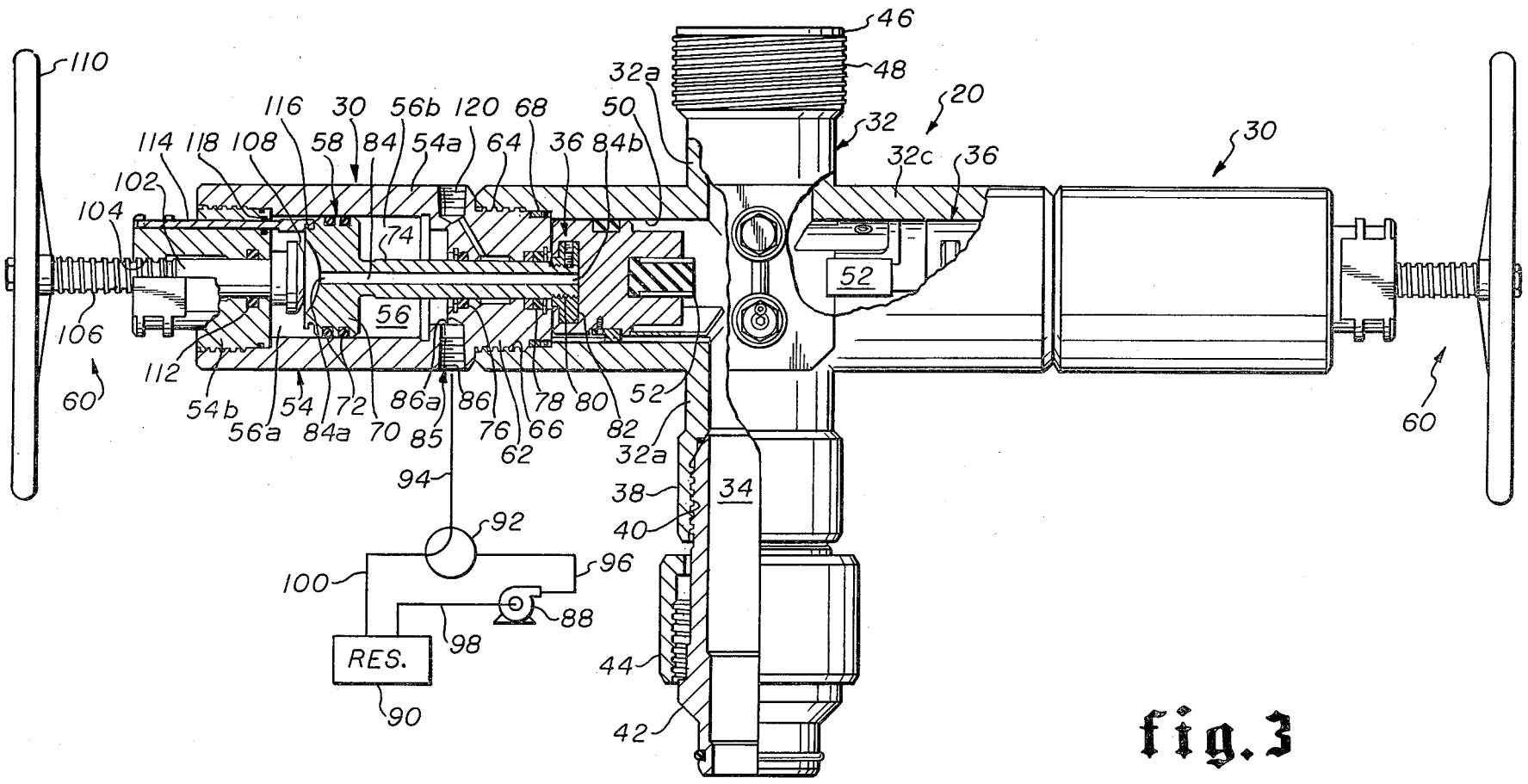
FIG. 3 is an illustration of the preventer and actuator of FIG. 2 with the preventer open.

FIGS. 2 and 3 illustrate the detailed structure of an actuator 30 in accordance with this invention and positioned on a wireline blowout preventer 20.

The wireline blowout preventer 20 includes body means 32 for defining a controlled flow path 34 and two opposed ram means 36 for opening and closing the flow path 34.

A longitudinally extending portion 32*a* of preventer body means 32 has a longitudinally extending bore which defines the controlled flow path 34. When the blowout preventer 20 is attached to the top of the wellhead 12, the flow path 34 is aligned with a vertical passage extending through the wellhead 12 into the well 10. One end 38 of the longitudinally extending body portion 42*b* is adapted to be connected with the top of the wellhead 12. This lower end 38 includes connector means, such as the threads 40 shown, to which adapter sub means 42 may be connected. Connecting collar means 44 interconnects adapter sub means 42 and the top of the wellhead 12. The other, upper end 46 of the longitudinal extending body portion 32*a* includes means 48 for interconnecting the lubricator 22 with the wireline blowout preventer 20. These interconnecting means 48 may be the threads shown. The preventer body means 32 also includes transversely extending, axially aligned, and laterally diametrically opposed portions 32*b* and 32*c*. The transversely extending portions 32*b* and 32*c* each define ram chamber means 50 opening into the flow path 34.

The opposed ram means 36 are disposed in the ram chamber means 50 and are longitudinally movable therein. The ram means 36 are movable within the preventer body means 32 between a first position (illustrated in FIG. 2) and a second position (illustrated in FIG. 3). In the first position of the ram means 36, the ram means 36 close the flow path 34 through the preventer 20. Each ram means 36 includes seal means 52 which are complementary to the seal means 52 of the other ram means 36. The complementary seal means 52 may be designed to abut and provide what is commonly referred to as a blind ram for closing the flow path 34. Alternatively, the complementary seal means 52 may be designed to seal around the wireline 16 or any other member which extends through the flow path 34.

Regardless of the operative position of the ram means 36 with respect to the peventer body means 32, there will be an upstream portion of the flow path 34 and a downstream portion of the flow path 34. The upstream portion of the flow path 34 is that portion into which fluids from the well 10 are first admitted. Since well fluids would flow upwardly through the well 10, the upstream portion of the flow path 34 is the lower portion below the ram means 36. The downstream portion of the flow path 34 is that portion through which flowing well fluids pass when they leave the blowout preventer 20. For upwardly flowing well fluids, the downstream portion of the flow path 34 is the upper portion of the flow path 34 above the ram means 36.

Actuator means 30 control movement of ram means 36. For the wireline blowout preventer 20 illustrated, two identical actuator means 30 are utilized. Each actuator means 30 controls movement of one ram means 36. Although the actuator means 30 may be operated independently of each other, they are preferably operated in unison so that ram means 36 either jointly move towards their first position or jointly move towards their second position. In FIGS. 2 and 3, one actuator means 30 is illustrated in section and the other actuator means 30 is illustrated in elevation.

The actuator means 30 comprises housing means 54 for defining piston cylinder means 56. Piston means 58 is movable within the cylinder means 56 and permits hydraulic movement of ram means 36. Upstream well fluid pressure from flow path 34 affects piston means 58 and produces a pressure force tending to urge piston means 58 towards a first position. Hydraulic control pressure from an external source also may affect piston means 58 and would create a pressure force tending to urge piston means 58 towards a second position. Mechanical means 60 may also advance piston means 58 towards their first position. Additionally, the mechanical means 60 may lock piston means 58 against movement towards their second position.

Housing means 54 includes an interior smooth walled bore for defining piston cylinder means 56. The actuator housing means 54 is adapted to be connected to preventer body means 32 in axial alignment with the respective ram means 36 whose movement the actuator 30 controls. The illustrated actuator housing means 54 includes an interconnected cylinder sleeve 54*a* and end cap 54*b*. The interconnection between the cylinder sleeve 54*a* and end cap 54*b* is fluid tight so that fluids affecting the piston means 58 are confined within the actuator 30. Formed on the end portion 62 of cylinder sleeve 54*a* opposite the interconnection with end cap 54*b* are threads 64. Threads 64 engage complementary threads 66 formed on the extreme end of the transversely extending portion 32*b* of body means 32. Seal means 68 seals between actuator housing means 54 and preventer body means 32 when the actuator 30 is connected to the preventer 20. Upstream well fluids from the flow path 34 are thereby prevented from escaping through the interconnection.

Piston means 58 is disposed within the cylinder means 56 and is movable with respect to actuator housing means 54 therein. Piston means 58 includes a piston head 70 on which are carried seal means 72. Seal means 72 seal between the piston head 70 and the interior smooth wall of cylinder sleeve 54*a*. Pressurized fluid within the cylinder means 56 affects piston means 58 and creates a pressure force tending to move piston means 58. Piston means 58 is adapted to be operably associated with one of the preventer ram means 36 whenever the actuator 30 is interconnected with the blowout preventer 20. Piston means 58 includes stem means 74 extending axially through the end portion 62 of actuator housing means 54 and into ram chamber means 50. To maintain the integrity of both the ram chamber means 50 and the piston cylinder means 56, spaced seal means 76 and 78 seal between the end portion 62 of actuator housing means 54 and stem means 74 of piston means 58. The end portion 80 of stem means 74 is threaded and interconnects with a compelmentary threaded connecting cap 82. The connecting cap 82 is associated with ram means 36. Once piston stem means 74 is threaded into the connecting cap 82, piston means 58 and ram means 36 are operably associated so that movement of one results in a corresponding movement of the other and vice versa. Thus, when piston means 58 is in its first position (see FIG. 2), ram means 36 is in its first position closing the flow path 34. When piston means 58 is in its second position (see FIG. 3), ram means 36 is in its second position opening the flow path 34.

The actuator means 30 is hydraulically operable. One source of fluid for actuator means 30 is fluid from the upstream portion of the flow path 34. Communicating means extend between the upstream portion of flow path 34 and one portion 56*a* of cylinder means 56. The pressure force exerted by the upstream fluid admitted to the one portion 56*a* tends to urge piston means 58 towards its first position. Due to the relative pressure responsive areas of piston seal means 72 and the spaced seal means 76 and 78, the net pressure force due to upstream well fluids tends to urge piston means 58 and ram means 36 towards their first position. To assure continuous confinement of upstream well fluids, the communicating means from flow path 34 to cylinder means portion 56*a* are defined by a bore 84 extending longitudinally through piston head means 70 and piston stem means 74 of piston means 58. One end 84*a* of the bore 84 opens on one side of piston means 58 in the one portion 56*a* of cylinder means 56. The other end 84*b* of bore 84 opens in ram chamber means 50 through clearances between and around connecting cap 82 in ram means 36. Fluids in the upstream portion of the flow path 34 communicate with the opening 84*b* of the bore 84 through keyways in the lower inside of body portions 32*b* and 32*c*, around loose fitting keys therein, and into ram chamber means 50. Regardless of direction of movement of piston means 58, no well fluids are bled from the blowout preventer 20 and actuator 30. Instead, well fluids are entirely confined therein. For example, during movement of piston means 58 from its first position towards its second position, those well fluids which are present within the one portion 56*a* of cylinder means 56 will be forced back into the upstream portion of the flow path 34 through above defined communicating means.

So that actuator means 30 can hydraulically open the preventer 20, actuator means 30 includes means 85 for admitting hydraulic control fluid from an external source to the other portion 56*b* of cylinder means 56. Once admitted to this other portion 56*b* of cylinder means 56, the hydraulic control fluid affects piston means 58 and produces a pressure force tending to urge piston means 58 towards its second position. The control fluid admitting means 85 comprises port means 86 extending through housing cylinder sleeve 54*a* and opening, at 86*a*, in the other portion of cylinder means 56. Regardless of the position of piston means 58, seal means 72 will be disposed between the opening 86*a* of port means 86 in cylinder means 56 and the opening 84*a* of communicating means 84 in cylinder means 56.

In FIGS. 2 and 3, an external hydraulic control system for the actuator 30 is schematically illustrated. A pump 88 pressurizes hydraulic control fluid from a convenient source, such as reservoir 90. Valve means 92 controls communication of hydraulic control fluid between pump means 88 and port means 86 and between reservoir 90 and port means 86. Conduit means 94, 96, 98 and 100 extend between port means 86 and valve means 92, between valve means 92 and pump means 88, between pump means 88 and reservoir 90, and between valve means 92 and reservoir 90, respectively. Valve means 92 is movable between two positions. In a first position (see FIG. 2), hydraulic control fluid communicates between pump means 88 and port means 86. In a second position of valve means 92 (see FIG. 3), hydraulic control fluid communicates between port means 86 and reservoir 90. When valve means 92 is in its first position and when pump means 88 has pressurized the hydraulic control fluid to a pressure greater than the pressure of fluids in the upstream portion of the flow path 34, piston means 58 is moved by the pressurized control fluid to its second position.

If desired, movement of piston means 58 towards their first position, and consequently movement of ram means 36 towards their first position, may be assisted by mechanical means 60. Additionally, once piston means 58 have obtained their first position, they may be mechanically locked against movement towards their second position. The ram means 36 may also be mechanically locked against movement towards their second position. The mechanical advancing and locking means 60 functions in only one direction. In other words, it cannot advance the piston means 58 towards their second position. Nor can it lock the piston means 58 in its second position. Moreover, piston means 58 can move towards their first position independently of the mechanical means 60 and without interference from the mechanical means 60.

The mechanical means 60 for advancing piston means 58 towards their first position and/or locking the piston means 58 against movement towards their second position includes movable push rod means 102. The end cap **54*b* of actuator housing means 54 is journaled at 104 with threads. The push rod means 102 has complementary threads 106 and extends through the journal 104. The push rod means 102 includes an abutment head 108. Rotation of push rod means 102 within the threaded journal 104 of housing end cap 54*b* either advances the abutment head 108 into cylinder means 56 or retracts the abutment head 108. Handle means 110 may be incorporated on push rod means 102 to provide mechanical advantage for rotation thereof. To confine fluids to cylinder means 56, seal means 112 seal between push rod means 102 and the housing end cap 54*b***.

Since actuator means 30 can move ram means 36 to their closed position without movement of the push rod means 102, position indication means 114 indicates the relative position of piston means 58 with respect to actuator housing means 54. The position indication means 114 comprises a rod which is hooked to piston means 58 at 116. The rod 114 therefore moves whenever piston means 58 moves. The position indication rod 114 extends out of cylinder means 56 through housing end cap **54*b*. When piston means 58 is in its first position, the position indication rod 114 not is visible (see FIG. 2) from the exterior of actuator means 30. When piston means 58 is in its second position, the position indication rod 114 is visible from the exterior of actuator means 30 (see FIG. 3). Seal means 118 seal between the end cap 54*b* and the position indication rod 114 to prevent fluids from escaping from cylinder means 56**.

If seal means 78 fails, the seepage of upstream well fluids there past could exert a pressure force tending to move piston means 58 and ram means 36 towards their second position. Relief means are provided by port means 120 extending through actuator housing means 54 and opening between the spaced seal means 76 and 78. Failure of seal means 78 can be quickly ascertained by the presence of well fluids in port means 120. From port means 120, the well fluids may be conducted to a convenient disposal location. Alternatively, port 120 can be utilized to pump sealing material into the annular area between actuator housing means 54 and piston stem means 74. Such corrective measures will permit limited continued operation of actuator means 30 and the blowout preventer 20.

In operation, the actuator 30 of this invention is utilized to control movement of the rams 36 of a wireline blowout preventer 20.

Prior to performing wireline operations in a well, a blowout preventer 20 with two actuators 30 attached thereto (one for each of the opposed ram means 36 of the preventer 20) would be connected to the top of the wellhead 12. A lubricator 22 is connected above the blowout preventer 20. Through a wireline stuffing box 24, wireline is fed into the lubricator 22 from a convenient storage means (not shown). The lubricator 22 is broken down. The item of well equipment 14 to be run into the well is attached to the wireline and pulled within the lubricator 22. The lubricator is reconnected to the blowout preventer 20. Thereafter the valves 18 of the wellhead 12 may be opened and well fluids will be confined by the lubricator 22 and wireline stuffing box 24 throughout normal operations.

The blowout preventer 20 is opened to run the well equipment 14 and wireline 16 through the well 10. Actuator 30 opens the blowout preventer 20 hydraulically. If necessary, the push rod means 102 is moved to its retracted position by turning handle means 110. Valve means 92 is turned to its first position (see FIG. 2). Pump means 88 pressurizes hydraulic control fluid and pumps it into cylinder means 56 through admitting means 86. Once the hydraulic control fluid is pressurized a sufficient amount, piston means 58 moves to its second position (see FIG. 3) and moves ram means 36 to their second, flow path opening position. During the opening of the blowout preventer 20, any fluids from the upstream portion of the flow path that have entered the one portion **56*a* of the cylinder means 56 will be forced back into the flow path 34**.

Once the blowout preventer 20 has been opened, it will remain open as long as hydraulic control pressure exceeds the pressure of fluids from the upstream portion of the flow path 34. Closure of the blowout preventer 20 is initiated by actuator means 30 whenever upstream well fluid pressure exceeds hydraulic control fluid pressure. Upstream well fluid pressure will exceed hydraulic control fluid pressure under two circumstances, in both it is desirable to close the blowout preventer 20. A first circumstance is when the well back kicks. If not controlled, the fluid pressure associated with a well back kick can initiate rapid upward flow of well fluids through the well 10. The second condition occurs whenever there is a failure in the hydraulic control system. For example, the pump 96 may break or one of the fluid conduits 94, 96, 98 and 100 may break. Utilizing a conventional system wherein hydraulic control pressure both opens and closes the preventer, without control fluid pressure assistance, it may be exceedingly difficult to manually close a blowout preventer. However, with this invention, failure of the hydraulic control system will initiate closure of the preventer 20.

Preferably, whenever closure of the preventer 20 is desired, valve means 92 is turned to its second position (see FIG. 3). Valve means 92 may be a pilot valve which automatically assumes its second position whenever control fluid pressure falls below a minimal value and/or whenever well pressure exceeds a minimal value or value means 92 may be manually operated. With valve means 92 in its second position, hydraulic control fluid from cylinder means 56 will bleed to reservoir 90. Regardless of the operative position of valve means 92, actuator means 30 closes the preventer 20 whenever upstream well fluid pressure exceeds hydraulic control fluid pressure. The pressure of fluids from the upstream portion of the flow path 34 will be effective within the one portion 56*a* of cylinder means 56 to urge piston means 58 towards its first position. As hydraulic control fluid bleeds out of the other side 56*b* of cylinder means 56, piston means 58 moves towards its first position. Movement of piston means 58 occurs independently of the push rod means 102 and without interference from the push rod means 102. However, if desired, push rod means 102 can be rotated by turning handle means 110 to advance piston means 58 towards its first position. Once piston means 58 attains its first position, the flow path 34 through the preventer 20 is closed. Depending upon the ram means 36 employed and depending upon the type of operations being conducted in the well, the seal means 52 of the ram means 36 either provide a blind seal, seal around the wireline, or seal around the other equipment extending through the preventer 20. Once the ram means 36 have closed the flow path 34 through preventer 20, push rod means 102 may be advanced the fullest extent possible into cylinder means 56. Its abutment head means 108 will backup piston means 58 and prevent movement thereof towards its second position. Therefore ram drift is prevented and the ram means 36 will remain in their closed position.

The blowout preventer 20 will remain closed until the push rod means 102 is retracted. Even once the push rod means 102 is retracted, the blowout preventer 20 will remain closed until control fluid of a pressure exceeding the pressure of well fluids in the upstream portion of the flow path 34 is admitted to the control fluid portion 56*b* of cylinder means 56.

From the foregoing, it can be seen that the objects of this invention have been obtained. The actuator for the wireline blowout preventer utilizes upstream well fluids to create a pressure force for closing the preventer. The upstream well fluids continuously affect a piston of the actuator and continuously produce a pressure force tending to urge the actuator to a position closing the preventer. To maintain the preventer in an open position, hydraulic control pressure is utilized to counter the upstream well fluids pressure. Whenever the pressure of upstream well fluids exceeds hydraulic control pressure, closure of the preventer is initiated. The pressure force of the upstream well fluids and a mechanical force may be utilized to close the preventer. Because of the positive application of the well fluid pressure force, closure of the preventer is much more easily obtainable than has heretofore been possible with conventional hydraulic actuators. Once the preventer has been closed by the actuator, the actuator may be mechanically locked in a position maintaining the preventer closed. To open the preventer, the mechanical locking means are retracted. Hydraulic control pressure in excess of the pressure of the upstream well fluids thereafter moves the actuator to a position opening the preventer. During the opening sequence, no well fluids are bled from the actuator. Instead, all well fluids are confined within the actuator and the blowout preventer.

The foregoing disclosure and description of the invention are illustrative and explanatory thereof. Various changes in the size, shape and materials, as well as the details of the illustrated construction, may be made within the scope of the appended claims without departing from the spirit of the invention.

What is claimed is:

1. In a wireline blowout preventor connectable to a well head having a housing with a vertical flow path for the flow of well fluids under pressure and rams movable transversely in said housing to open and close said vertical flow path, the improvement consisting of actuators for actuating movement of said rams, each actuator comprising:

an actuator having, connectable to said wireline blowout preventor housing, having a longitudinal bore transverse to said vertical flow path, piston means disposed in said longitudinal bore, a portion of said longitudinal bore forming a first variable capacity pressure chamber for receiving a pressure fluid from a source outside said actuator housing wherein an increase in pressure therein causes said piston means to move said respective ram to open said vertical flow path, port means to provide fluid communication between the exterior of said actuator housing and said first variable capacity pressure chamber, a portion of said longitudinal bore forming a second variable capacity pressure chamber for receiving pressure from said well, connector means connecting said piston and said ram, having a bore passageway extending therethrough in communication with a bore passageway extending through said piston, providing fluid communication between said second variable capacity pressure chamber and said vertical flow path, whereby a pressure in said well exceeding the pressure in said first variable capacity pressure chamber causes said pistons to move said rams to a position closing said vertical flow path.

2. The actuator of claim 1, including means for mechanically advancing said piston means toward a position wherein said rams close vertical flow path.

3. The actuator of claim 1, including means for locking said piston means in a position wherein said rams are held in the vertical flow path closed position.

4. The actuator of claim 1, including means connected to said piston and extendable outside said actuator housing for indicating the position of said rams.

5. In a wireline blowout preventor connectable to a well head having a housing with a vertical flow path for the flow of well fluids under pressure and rams movable transversely in said housing to open and close said vertical flow path, the improvement consisting of actuators for actuating movement of said rams each actuator comprising:

an actuator housing, connectable to said wireline blowout preventor housing, having a longitudinal bore transverse to said vertical flow path, piston means disposed in said longitudinal bore, being movably responsive to pressure changes therein:

a portion of said longitudinal bore forming a first variable capacity pressure chamber for receiving a pressure fluid from a source outside said actuator housing, wherein an increase in pressure therein causes said piston means to move said respective ram to open said vertical flow path, said pressure fluid being communicated from outside to said first variable capacity pressure chamber through a port in said actuator housing, a portion of said longitudinal bore forming a second variable capacity pressure chamber for receiving pressure only from said well; and a connector means connecting said piston and said ram, having a bore passageway extending from the end thereof connected to said ram to the face of said piston exposed to pressure in said second variable capacity pressure chamber, wherein pressure in said well exceeding the pressure in said first variable capacity pressure chamber, entering said second variable capacity pressure chamber through said connector bore, causes said pistons to move said rams to a position closing said vertical flow path.

6. The actuator of claim 5, including means for mechanically advancing said piston means toward a position wherein said rams close vertical flow path.

7. The actuator of claim 5, including means for locking said piston means in a position wherein said rams are held in the vertical flow path closed position.

8. The actuator of claim 5, including means connected to said piston and extendable outside said actuator housing for indicating the position of said rams.

* * * * *